United States Patent [19]

Bourlet

[11] 4,145,831

[45] Mar. 27, 1979

[54] CLOSING DEVICE FOR THE SLOT THROUGH WHICH PASSES THE COCKING LEVER OF AUTOMATIC WEAPONS

[75] Inventor: Maurice V. Bourlet, Liége, Belgium

[73] Assignee: Fabrique Nationale Herstal en abrege FN, Societe Anonyme, Herstal, Belgium

[21] Appl. No.: 870,186

[22] Filed: Jan. 17, 1978

[30] Foreign Application Priority Data

Apr. 15, 1977 [BE] Belgium ..... 255833

[51] Int. Cl.[2] ..... F41C 27/08

[52] U.S. Cl. ..... 42/16; 42/1 N

[58] Field of Search ..... 42/16, 1 N, 1 R

[56] References Cited

U.S. PATENT DOCUMENTS

| | | | |
|---|---|---|---|
| 1,043,717 | 11/1912 | Pesek | 42/16 |
| 1,365,592 | 1/1921 | Johnston | 42/1 N |
| 1,515,415 | 11/1924 | Ronningen | 42/1 N |
| 1,523,067 | 1/1925 | Hazelton | 42/16 |

*Primary Examiner*—Charles T. Jordan

*Attorney, Agent, or Firm*—Bacon & Thomas

[57] ABSTRACT

Closing device for the slot through which passes the cocking lever of automatic weapons, the slot being provided in the casing of the latter, characterized by the fact that it is mainly made up of: a shaped flap provided with a cut-out portion at each of its ends; two posts which are integral with the casing and pass through each of aforesaid cut-out portions; and a spring hooked by its ends onto aforesaid posts and attached in its center to aforesaid flap, so as to press the latter against the casing and to stress it towards its closing position of the slot.

4 Claims, 5 Drawing Figures

CLOSING DEVICE FOR THE SLOT THROUGH WHICH PASSES THE COCKING LEVER OF AUTOMATIC WEAPONS

The present invention pertains to a closing device for the slot through which passes the cocking lever of automatic weapons, the slot being provided in the casing of the weapon.

The purpose of the invention is to avoid the entry of foreign matter into aforesaid casing, while in no way impeding the movement of the cocking lever.

For this purpose, the device according to the invention is mainly made up of : a shaped flap provided with a cut-out portion at each end; two posts which are integral with the casing and which each pass through one of aforesaid cut-out portions; and a spring hooked at its ends over aforesaid posts and attached at its center to aforesaid flap, so as to press the latter against the casing and to stress it towards the slot closing position.

In order to illustrate what is said above, a constructional example of the invention is described hereinafter in greater detail with reference to the appended drawings in which.

In the present case, the weapon shown is an automatic rifle of which the casing 1 is provided with a slot 2, through which passes a cocking lever 3 which is integral with the moving breech of the weapon as is well known.

Figure 3:
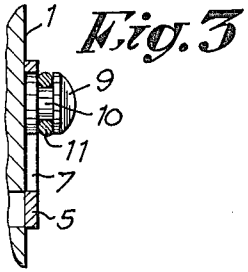
FIG. 3 is a section according to line III—III in FIG. 2.
Figure 4:
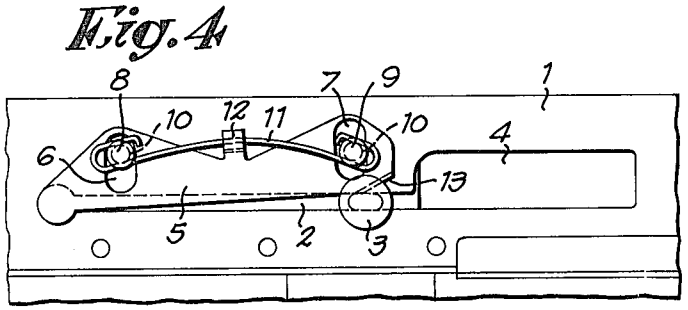
FIGS. 4 and 5 are similar views to that of FIG. 2 showing the device in two characteristic operating positions.

The closing device according to the invention consists of a flap 5 provided, close to each of its ends, with cut-out portions or slots, 6 and 7. Posts, 8 and 9, which are integral with casing 1, each passes through one of these cut-out portions. Each of the posts is provided with a groove 10, which can be seen in FIG. 3.

Figure 1:
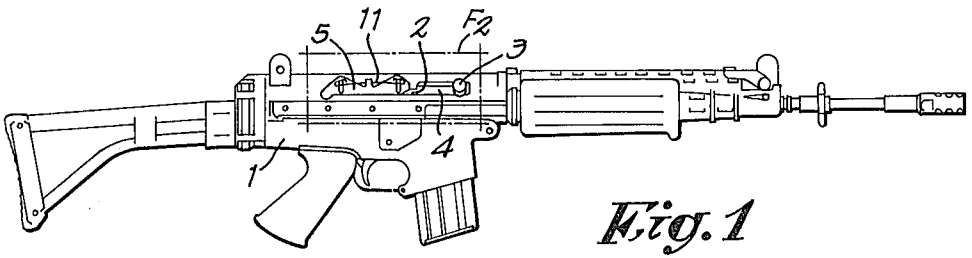
FIG. 1 shows a weapon which is fitted with the device according to the invention.
Figure 2:
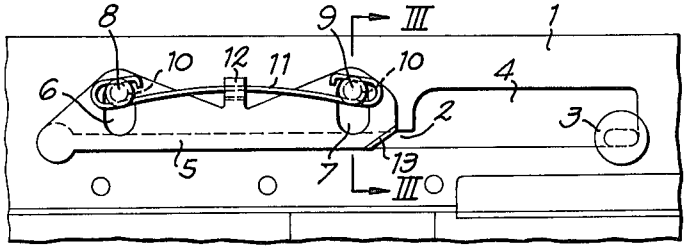
FIG. 2 shows, to a larger scale, that part of FIG. 1 which is identified by F2.

A spring 11, with bent over ends, is attached to the central part of flap 5 by means of a fixing lug 12 provided on said flap for this purpose. In this manner, spring 11 presses flap 5 against casing 1 and permanently stresses it towards its slot closing position (FIG. 2). Flap 5 can however perform movements of rotation and of translation, the maximum amplitude of which is determined by the shape and dimensions of cut-out portions 6 and 7, with respect to the diameter of posts 8 and 9.

Figure 5:
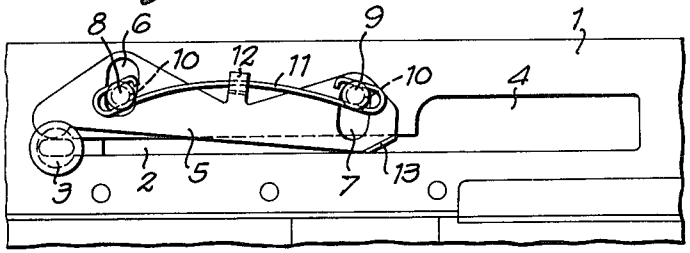

The front end of flap 5 is provided with a bent over part 13, which is intended to engage lever 3 when the latter is operated, so as to cause flap 5 to swivel in order to free the access to slot 2. During the remainder of the movement, lever 3 engages the lower edge of flap 5 (FIG. 5).

By these arrangements, the penetration of foreign matter (dust, mud, sand . . .) into casing 1 is prevented, so that the proper operation of the weapon is not impaired.

It is obvious that alterations can be applied to the device described above as an illustrating and non limiting example, without going beyond the scope of the invention.

What I claim is:

1. An automatic weapon having a casing provided with an elongated slot and a cocking lever extending outwardly through said slot and being slidable therealong, the improvement comprising:

a shaped flap provided with a cut-out portion at each of its ends; two posts rigid with the casing, each post passing through one of aforesaid cut-out portions; and a spring hooked at its ends onto aforesaid posts and attached in its center to aforesaid flap, so as to press the latter against the casing and to stress it towards its slot closing position.

2. Device according to claim 1, characterized by the fact that each of aforesaid posts is provided with a groove for receiving the corresponding bent over ends of aforesaid spring.

3. Device according to claim 1, characterized by the fact that the spring is attached by its central part to aforesaid flap, by means of a bent over lug which is integral with the latter.

4. Device according to claim 1, characterized by the fact that the front end of the flap has a bent over portion which forms a slanting surface to be engaged by the cocking lever, when the latter is being operated.

* * * * *